US005870915A

United States Patent [19]

D'Hont

[11] Patent Number: 5,870,915

[45] Date of Patent: Feb. 16, 1999

[54] KEY LOCK HAVING INDUCTIVE KEY DETECTION AND METHOD OF CONSTRUCTION

[75] Inventor: Loek D'Hont, Almelo, Netherlands

[73] Assignee: Texas Instruments Incorporated, Dallas, Tex.

[21] Appl. No.: 909,145

[22] Filed: Aug. 11, 1997

Related U.S. Application Data

[63] Continuation of Ser. No. 689,961, Aug. 16, 1996, abandoned, which is a continuation of Ser. No. 347,769, Nov. 30, 1994, abandoned.

[51] Int. Cl.[6] ..... E05B 49/00

[52] U.S. Cl. ..... 70/278; 70/277; 70/280

[58] Field of Search ..... 70/276, 278, 279–283

[56] References Cited

U.S. PATENT DOCUMENTS

| | | | |
|---|---|---|---|
| 3,706,948 | 12/1972 | Choi et al. | 333/73 |
| 4,253,320 | 3/1981 | Schwab et al. | 70/276 |
| 4,576,025 | 3/1986 | Kassza et al. | 70/276 |
| 4,737,755 | 4/1988 | Hopmans | 336/178 |
| 4,807,854 | 2/1989 | Sengupta et al. | 70/277 |
| 4,939,915 | 7/1990 | Vonlanthen | 70/279 X |
| 4,982,587 | 1/1991 | Tzou | 70/277 X |
| 5,010,750 | 4/1991 | Böser et al. | 70/238 X |
| 5,184,490 | 2/1993 | Takahashi | 70/277 |
| 5,313,037 | 5/1994 | Hansen et al. | 219/632 |
| 5,351,042 | 9/1994 | Aston | 70/283 |
| 5,469,727 | 11/1995 | Spahn et al. | 70/278 |
| 5,507,162 | 4/1996 | Chhatwal | 70/283 |
| 5,552,777 | 9/1996 | Gokcebay et al. | 70/278 |

FOREIGN PATENT DOCUMENTS

| | | |
|---|---|---|
| 0 324 096 A2 | 7/1989 | European Pat. Off. . |
| 0 525 730 A1 | 2/1993 | European Pat. Off. . |
| 2 196 685 | 5/1988 | United Kingdom . |

*Primary Examiner*—Suzanne Dino Barrett
*Assistant Examiner*—Tuyet-Phuong Pham
*Attorney, Agent, or Firm*—Rebecca Mapstone Lake; Richard L. Donaldson

[57] ABSTRACT

A lock (10) having inductive key detection includes a lock mechanism (14). A detector member (20) is movably disposed proximate the lock mechanism (14) such that the detector member (20) moves when a key engages the lock mechanism (14). The detector member (20) has a magnetic portion (24). An antenna (30) is disposed proximate the detector member (20) such that movement of the detector member (20) induces a signal in the antenna (30). A detector (42) is coupled to the antenna (30) and is operable to detect the signal in the antenna (30).

15 Claims, 2 Drawing Sheets

KEY LOCK HAVING INDUCTIVE KEY DETECTION AND METHOD OF CONSTRUCTION

This application is a Continuation of application Ser. No. 08/689,961 filed on Aug. 16, 1996, abandoned which is a Continuation of application Ser. No. 08/347,769 filed on Nov. 30, 1994, now abandoned.

TECHNICAL FIELD OF THE INVENTION

This invention relates in general to the field of electronic devices, and more particularly to a key lock having inductive key detection and a method of construction.

BACKGROUND OF THE INVENTION

Key lock systems are used to provide secure access to houses, buildings, cars and other such property. Generally, a key lock system includes a key lock and a key. The key lock generally includes a lock housing and a lock mechanism having a keyhole. The key is constructed such that it engages the keyhole and locks and unlocks the lock mechanism. Only a properly constructed key will function in a given key lock. One type of conventional key lock is a key lock having a rotating lock cylinder. In this type of key lock, a number of lock pistons are moved by a key inserted into a keyhole in the rotating lock cylinder. The correct key will position the lock pistons such that the rotating lock cylinder will rotate with the key. In this manner, the lock is locked and unlocked.

It is advantageous for some applications to provide security in addition to a mechanical match between the key and the key lock. One way to provide additional security is to construct the key lock such that the key lock can interrogate and identify whether a key is the correct key. Some of these key lock systems include a transponder in the key and an interrogation antenna and electronics in the key lock. If the key is not correct, the system may remain electrically locked even though mechanically unlocked. If the key is the correct key, the key lock can be both mechanically and electrically locked and/or unlocked.

It is a problem with key interrogation systems to activate interrogation efficiently. The interrogation electronics need to be triggered only when a key is proximate to or preferably inserted into the keyhole. One conventional method allows the interrogation electronics to run constantly, but this shortens the lifetime of any key lock system in which a battery is used. An alternate method is to use a contact switch in the keyhole. However, this generates a problem in that extra wires associated with the contact switch are required to extend from the lock mechanism. The contact switch and extra wires are subject to wear and tear and require extra modifications to conventional key lock systems.

SUMMARY OF THE INVENTION

A need has arisen for a key lock that efficiently activates interrogation electronics when a key is inserted into the key lock.

In accordance with the present invention, a key lock having inductive key detection and a method of construction are provided that substantially reduce or eliminate problems of conventional key lock systems.

According to one embodiment of the present invention, a key lock is provided that includes a lock mechanism. A detector member is movably disposed proximate the lock mechanism such that the detector member moves when a key engages the lock mechanism. The detector member has a magnetic portion. An antenna is disposed proximate the detector member such that movement of the detector member induces a signal in the antenna. A detector is coupled to the antenna and is operable to detect the signal in the antenna.

BRIEF DESCRIPTION OF THE DRAWINGS

A more complete understanding of the present invention and advantages thereof may be acquired by referring to the following description taken in conjunction with the accompanying drawings in which like reference numbers indicate like features, and wherein.

DETAILED DESCRIPTION OF THE INVENTION

Figure 1:
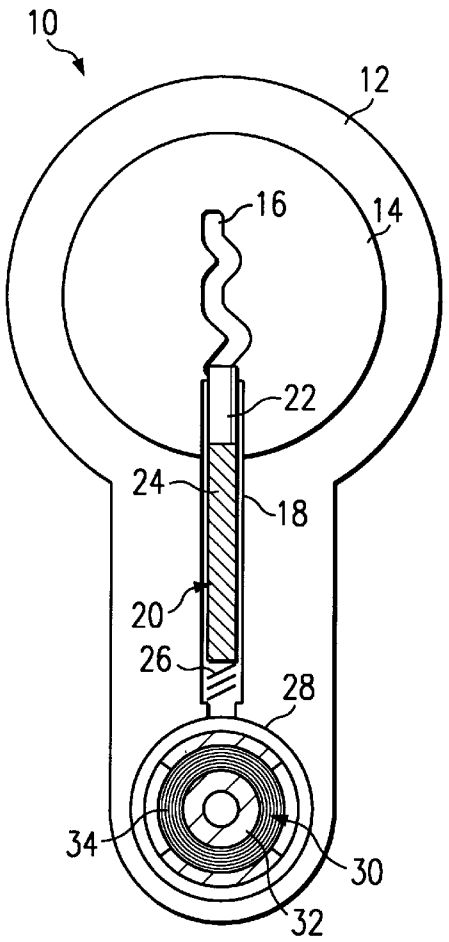
FIG. 1 is a front view with portions broken away of one embodiment of a key lock having inductive key detection constructed according to the teachings of the present invention.

FIG. 1 illustrates a key lock, indicated generally at 10, constructed according to the teachings of the present invention. Key lock 10 comprises a lock housing 12 and a rotating lock cylinder 14. Rotating lock cylinder 14 defines a keyhole 16. As shown, a shaft 18 intersects keyhole 16, extends through rotating lock cylinder 14 and into lock housing 12. Key lock 10 includes additional lock piston shafts as appropriate for rotating lock cylinder 14 as described in more detail with respect to FIG. 2.

A detector lock piston 20 is disposed in shaft 18. Detector lock piston 20 comprises an upper portion 22 and a lower portion 24. Upper portion 22 and lower portion 24 are movable with respect to one another in the manner of conventional lock pistons. Upper portion 22 is constructed from steel or other suitable material. According to the teachings of the present invention, lower portion 24 is constructed from a material comprising a strong permanent magnet such as a cobalt magnet. Detector piston 20 is supported within shaft 18 by a spring 26 in the manner of conventional lock pistons.

Lock housing 12 defines an antenna housing 28. Shaft 18 terminates proximate antenna chamber 28, as shown. Antenna housing 28 is sized to hold a flushed interrogation antenna, indicated generally at 30. According to the teaching of the present invention, flushed interrogation antenna 30 comprises a half-core 32 and a coil winding package 34. In one embodiment of the present invention, half-core 32 comprises a ferrite potcore half, or alternatively an E-core half.

In operation, key lock 10 detects the presence of a key engaging keyhole 16 and activates interrogation electronics for determining whether the key matches key lock 10. When a key is inserted into keyhole 16, detector piston 20 moves within shaft 18. In the illustrated embodiment, detector piston 20 moves upward and downward within shaft 18. When lower portion 24 moves with respect to flushed interrogation antenna 30, a current is induced in flushed interrogation antenna 30. This current comprises a low frequency signal generated due to the moving magnetic field of lower portion 24. The low frequency signal is sensed by key lock 10 and used to activate interrogation electronics as described in more detail with respect to FIG. 2.

Figure 2:
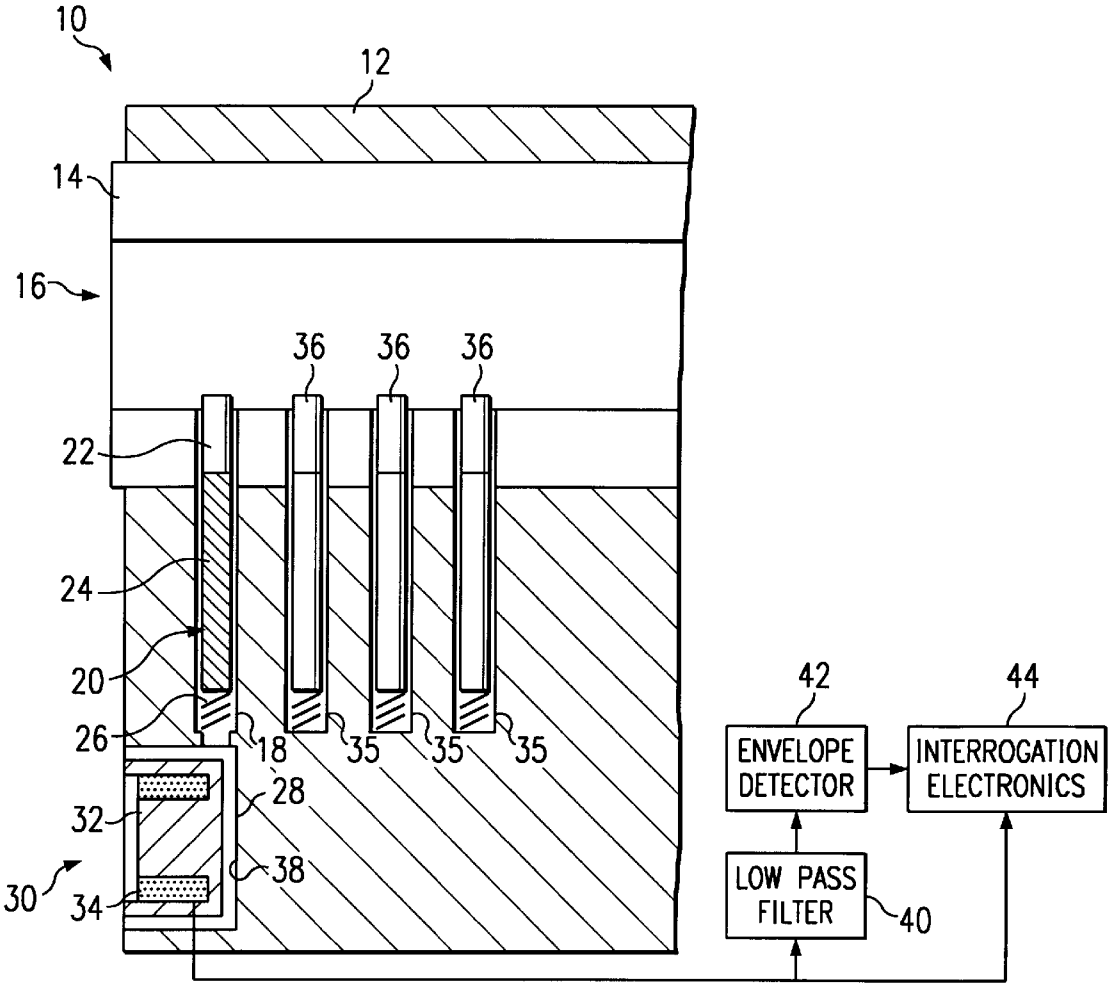
FIG. 2 is a side view with portions broken away of one embodiment of a key lock having inductive key detection constructed according to the teachings of the present invention.

FIG. 2 is a side view with portions broken away of key lock 10. Key lock 10 comprises a plurality of shafts 35 in addition to shaft 18, as shown. The number of shafts 35 vary depending upon the desired application. In the illustrated embodiment and for simplicity, key lock 10 includes only three shafts 35. However, it will be appreciated that similar locks may have five, six or even more shafts and pistons. A conventional lock piston 36 is disposed in each shaft 35. Each lock piston 36 includes an upper portion and a lower portion. In the manner of conventional cylinder locks, lock pistons 36 and detector piston 20 prevent the rotation of rotating lock cylinder 14 unless the correct key is inserted in keyhole 16.

Antenna chamber 28 has a back wall 38. In the embodiment of FIG. 2, shaft 18 is aligned with back wall 38. In another embodiment of the present invention, shaft 18 is aligned with respect to back wall 38 such that lower portion 24 of detector piston 20 extends through lock housing 12 when detector piston 20 moves downward. This embodiment is shown in FIG. 3.

Coil winding package 34 of flushed interrogation antenna is coupled to a low pass filter 40. Low pass filter 40 provides a signal to an envelope detector 42 which in turn provides a signal to an interrogation electronics 44. Interrogation electronics 44 is also coupled to coil winding package 34 of flushed interrogation antenna 30.

Figure 3:
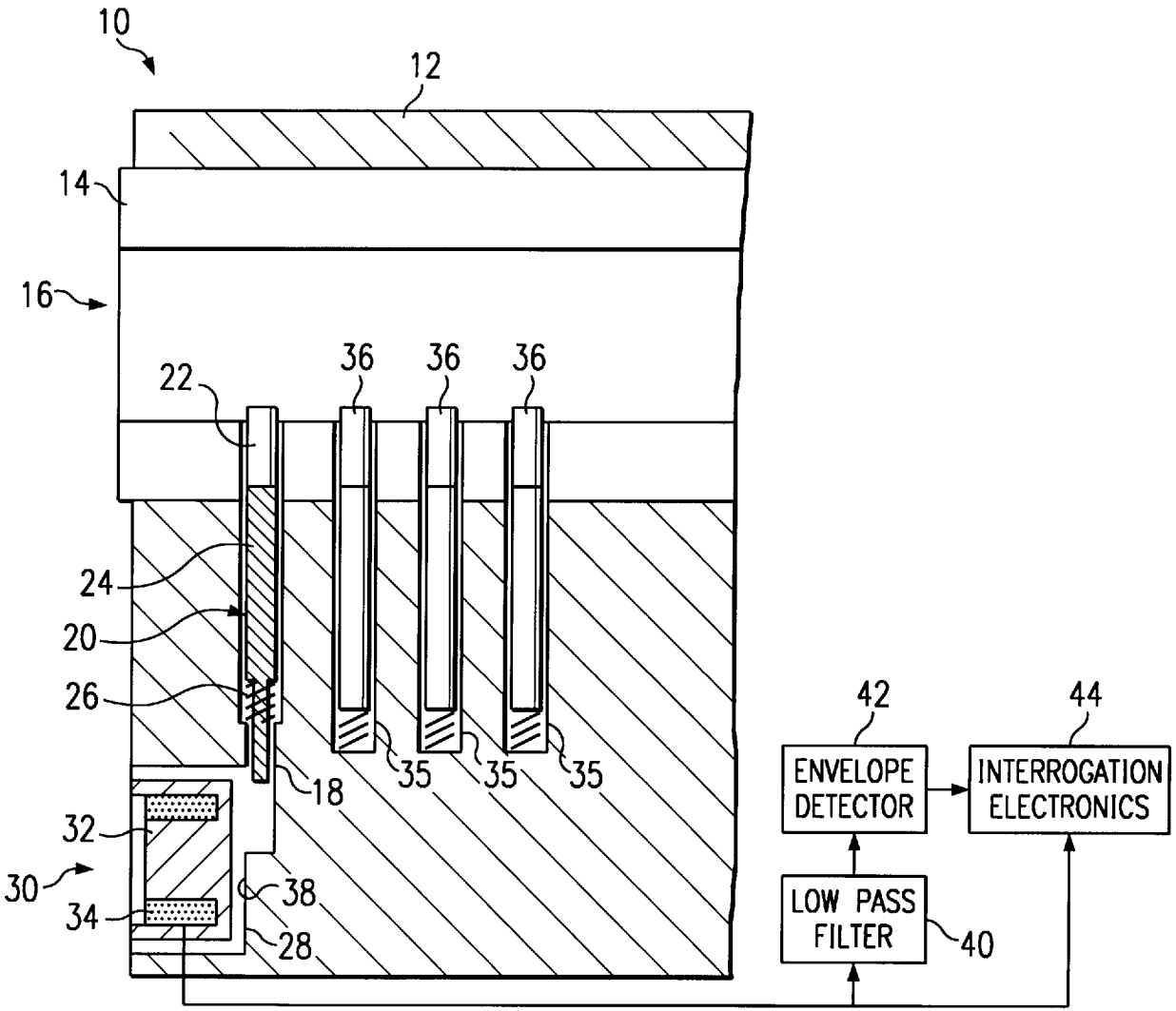
FIG. 3 is a side view with portions broken away of another embodiment of a key lock having inductive key detection constructed according to the teachings of the present invention.

According to the operation of the embodiment of FIGS. 2 and 3, insertion of a key into keyhole 16 causes movement of detector piston 20. Corresponding movement of lower portion 24 and the associated magnetic field induces a low frequency signal in coil winding package 34 of flushed interrogation antenna 30. This low frequency signal is provided to low pass filter 40 and interrogation electronics 44. Interrogation electronics 44 is initially in a standby mode and does not process the low frequency signal.

Low pass filter 40 receives the low frequency signal, filters any high frequency noise, and provides a filtered low frequency signal to envelope detector 42. Envelope detector 42 receives the filtered low frequency signal from low pass filter 40 and determines whether the signal corresponds to the type produced by movement of lower portion 24 of detector piston 20. If envelope detector 42 detects an appropriate signal, envelope detector 42 provides a start signal to interrogation electronics 44.

Upon receipt of a start signal from envelope detector 42, interrogation electronics 44 switches to an active state. In the active state, interrogation electronics 44 operates to interrogate the key inserted in keyhole 16 to determine whether the key is the appropriate key for key lock 10. If so, interrogation electronics 44 releases rotating lock cylinder 14. If not, interrogation electronics 44 prevents rotation of rotating lock cylinder 14. In one embodiment of the present invention, interrogation electronics 44 interrogates the key for a given period of time or until a successful read is obtained.

FIG. 3 is a side view with portions broken away of another embodiment of key lock 10. Shaft 18 is aligned with respect to back wall 38 of antenna chamber 28 such that lower portion 24 of detector piston 20 extends through lock housing 12 when detector piston 20 is moved downward. In this manner, lower portion 24 extends from lock housing 12 such that lock housing 12 does not interfere with the interaction of lower portion 24 with flushed interrogation antenna 30. This alignment prevents problems with interference that may be caused by a metallic lock housing such that a stronger signal is induced in flushed interrogation antenna 30.

A technical advantage of the present invention is the provision of an interrogation antenna that is flushed into the key lock housing to avoid mechanical vulnerability. An interrogation antenna constructed according to the teachings of the present invention is constructed from a ferrite potcore half or an E-core half. Due to the shape of the antenna core, the magnetic field lines extend to the front of the key lock where the transponder to be interrogated will be located.

Another technical advantage of the present invention is the use of a magnetic lock piston in place of one of the conventional lock pistons used in a rotating lock cylinder. Movement of the magnetic piston induces a current in the interrogation antenna. This current is detected by an envelope detector which provides a start signal for the interrogation electronics. An interrogation field can then be activated to read a transponder in a key. The interrogation electronics can return to a standby state after a read is accomplished.

Further technical advantages of the present invention include the saving of battery power for interrogation electronics and the saving of costs in constructing a key lock assembly. Battery power is saved by only activating interrogation electronics after a key is inserted in the keyhole. The key lock assembly is less expensive to construct because no key lock modification to house a switch is necessary and a pair of wires for the switch is not required.

Although the present invention has been described in detail, it should be understood that various changes, substitutions and alterations can be made hereto without departing from the spirit and scope of the invention as defined by the appended claims.

What is claimed is:

1. A lock having inductive key detection comprising:

a lock mechanism;

a detector member having a magnetic portion and movably disposed proximate the lock mechanism such that the detector member physically moves when a key engages the lock mechanism;

an interrogation antenna disposed proximate said detector member and comprising a magnetic core and a coil winding package such that said physical movement of said detector member electromagnetically induces a current signal in said interrogation antenna;

a detector coupled to the antenna and operable to detect said signal in said interrogation antenna and to generate an activation signal upon receipt of said signal;

interrogation electronics coupled to said detector, the interrogation electronics operable to receive the activation signal and switch to an active state in response, thereby interrogating a transponder on a key for authorization of the activation of a system upon receipt of a predetermined identification.

2. The lock of claim 1, wherein the magnetic portion of detector member is constructed from a permanent magnetic material.

3. The lock of claim 1, wherein the lock mechanism comprises a rotating lock cylinder having a keyhole.

4. The lock of claim 1, wherein the lock mechanism comprises a rotating lock cylinder having a keyhole, and wherein the detector member comprises a lock piston having an upper portion and the magnetic portion, the magnetic portion constructed from a permanent magnetic material.

5. The lock of claim 1, wherein the antenna comprises a flushed interrogation antenna having a ferrite potcore half.

6. The lock of claim 1, wherein the antenna comprises a flushed interrogation antenna having a ferrite E-core half.

7. The lock of claim 1, further comprising a filter operable to receive said signal in the antenna, filter the signal, and provide a filtered signal to the detector.

8. A key lock having inductive key detection, comprising:

a lock housing having an antenna chamber;

a rotating lock cylinder disposed in the lock housing and having a keyhole, the lock housing and the rotating lock cylinder define a shaft intersecting the keyhole extending into the lock housing and terminating proximate the antenna chamber;

a detector piston movably disposed in the shaft, the detector piston comprising an upper portion and a lower portion, wherein the lower portion is constructed from permanent magnetic material;

an interrogation antenna disposed in the antenna chamber and comprising a magnetic core and a coil winding package, such that movement of the lower portion of the detector piston in the shaft electromagnetically induces a current signal in the antenna;

an envelope detector coupled to the antenna, the envelope detector operable to detect said signal in the antenna and to provide an activation signal in response to detection of the signal; and interrogation electronics coupled to the envelope detector and the antenna, the interrogation electronics operable to receive said activation signal and to switch to an activate state in response.

9. The key lock of claim 8, further comprising a filter operable to receive the signal in the antenna, filter the signal, and provide a filtered signal to the detector.

10. The key lock of claim 8, wherein the antenna comprises a flushed interrogation antenna having a ferrite potcore half.

11. The key lock of claim 8, wherein the antenna comprises a flushed interrogation antenna having a ferrite E-core half.

12. A method of constructing a lock having inductive key detection, comprising the steps of:

providing a lock mechanism;

forming a detector member having a magnetic portion;

movably disposing said detector member proximate the lock mechanism, such that the detector member moves when the key engages the lock mechanism;

disposing an interrogation antenna having a magnetic core and a coil winding package proximate the detector member, such that movement of the detector member electromagnetically induces a current in the antenna;

coupling a detector to the antenna, the detector operable to detect the current in the antenna and to generate an activation signal, wherein said activation signal is a start signal for interrogation electronics for interrogating a transponder on a key.

13. The method of claim 12, wherein the step of forming a detector member comprises forming a detector member having a magnetic portion constructed from a permanent magnetic material.

14. The method of claim 12, wherein a lock mechanism comprises a rotating lock cylinder having a keyhole.

15. The method of claim 12, wherein the step of providing comprises providing a lock mechanism that comprises a rotating lock cylinder having a keyhole, and wherein the step of forming comprises forming a detector member that comprises a lock piston having an upper portion and a lower portion, the lower portion constructed from a permanent magnetic material.

* * * * *